United States Patent [19]

Spindt

[11] Patent Number: 5,064,396

[45] Date of Patent: Nov. 12, 1991

[54] METHOD OF MANUFACTURING AN ELECTRIC FIELD PRODUCING STRUCTURE INCLUDING A FIELD EMISSION CATHODE

[75] Inventor: Charles A. Spindt, Menlo Park, Calif.

[73] Assignee: Coloray Display Corporation, Fremont, Calif.

[21] Appl. No.: 472,336

[22] Filed: Jan. 29, 1990

[51] Int. Cl.[5] ..... H01J 9/02

[52] U.S. Cl. ..... 445/50; 313/309; 313/336; 313/351

[58] Field of Search ..... 313/336, 351, 309, 495; 445/50, 51, 52

[56] References Cited

U.S. PATENT DOCUMENTS

| | | | |
|---|---|---|---|
| 3,665,241 | 5/1972 | Spindt et al. | 313/309 X |
| 3,755,704 | 8/1973 | Spindt et al. | 313/309 |
| 3,789,471 | 2/1974 | Spindt et al. | 445/52 |
| 3,812,559 | 5/1974 | Spindt et al. | 445/52 |
| 3,998,678 | 12/1976 | Fukase et al. | 313/336 X |
| 4,818,914 | 4/1989 | Brodie | 313/351 X |

*Primary Examiner*—Palmer C. DeMeo

*Attorney, Agent, or Firm*—Flehr, Hohbach, Test, Albritton & Herbert

[57] ABSTRACT

An electric field producing structure especially suitable as electron or field forming sources in vacuum devices is disclosed herein along with its method of manufacture. The structure so disclosed includes upper and lower, generally planar electrodes spaced apart in parallel confronting relationship to one another with a dielectric layer therebetween so as to electrically insulate the electrodes from one another. A series of apertures are formed with the upper electrode and the dielectric layer. Each aperture is deeper than it is wide and contains a single electrically conductive protuberance extending up from the lower electrode. Each protuberance is formed in at least two stages by successive physical evaporative deposition processes so that the uppermost tip of each protuberance in its associated aperture is substantially coplanar with the upper electrode.

9 Claims, 3 Drawing Sheets

METHOD OF MANUFACTURING AN ELECTRIC FIELD PRODUCING STRUCTURE INCLUDING A FIELD EMISSION CATHODE

BACKGROUND OF THE INVENTION

The present invention relates generally to field-ionizing and electron-emitting structures utilizing field emission cathodes, as described in detail in U.S. Pat. Nos. 3,665,241; 3,755,704; 3,789,471; and 3,812,559, hereinafter referred to as the "Spindt" patents, which patents are incorporated herein by reference. The present invention relates particularly to a specifically improved method for making structures in a way which improves their operation.

Referring immediately to FIG. 1, an electric field producing structure, as disclosed in the Spindt patents and the prior art generally, is diagrammatically illustrated. This structure, which is generally indicated by the reference numeral 10, includes upper and lower generally planar electrodes 12 and 14 spaced apart in parallel confronting relationship to one another with a dielectric layer 16 therebetween so as to insure that the two electrodes are electrically insulated from one another. The lower electrode 14 may be self-supporting, or it may be mounted on a structural support base 18.

The overall electric field producing structure 10 includes a series of closely spaced apertures extending through upper electrode 12 and dielectric layer 16 so as to expose an upper surface segment of lower electrode 14. One such aperture is illustrated in FIG. 1 at 20. Note that the uppermost rim 22 of this aperture is actually the upper electrode's circumferential edge defining the top periphery of aperture 20. Note further that rim 22 is exposed to the surface segment of lower electrode 14 defining the bottom of the aperture. That surface segment is generally indicated at 24.

Still referring to FIG. 1, each aperture 20 contains a single electrically conductive protuberance 26 stemming up from surface segment 24 of electrode 14 such that its uppermost pointed end 28 is substantially coplanar with but spaced from rim 22. In an actual embodiment of the prior art, the apertures 20 are circular in cross-sectional configuration and each of the protuberances 26 is either cone shaped as shown, or includes a cylindrical base or pedestal with a cone shaped upper section. As will be seen hereinafter, the present invention is equally applicable to either shape and, in fact, other configurations. In this regard, it should be noted that the thicknesses of at least upper electrode 12 and dielectric layer 16 and the sizes of aperture 20 and protuberance 26 have been exaggerated for purposes of illustration. In an actual embodiment of the prior art, electrode 12 is approximately 1000–4000 angstroms thick, dielectric layer 16 is approximately 1 micron thick and, the diameter and depth of aperture 20 is approximately 1 $\mu$m. Thus, the base of the protuberance 26 is very slightly less than 1 $\mu$m while its height corresponds to the depth of aperture 20.

Having described dielectric field producing structure 10 generally, it is to be understood that a more detailed description may be found in the prior art generally and in the above recited Spindt patents specifications. As discussed in these patents, the structure 10 can be used as either an electron emitting source or as an electric field-ion producing source. In the former case, the lower electrode 14 and protuberance 26 are connected to a negative potential relative to the upper electrode 12 which is typically connected to a positive potential so that each of the protuberances 26 functions as an electron producing cathode, as illustrated in FIG. 1. The reverse is true when the structure functions as a field-ion producing force. That is, the lower electrode 14 and each of the protuberances 26 would be connected to a positive potential and the upper electrode 12 would be connected to a negative potential, in which case overall structure could function as a field-ionizing device. Both such arrangements are discussed in the prior art and reference is made thereto.

In order to further appreciate the present invention, it is important to briefly explain how protuberances 26 are formed within apertures 20 in accordance with the prior art generally and certain ones of the previously recited Spindt patents in particular. As described there, a physical evaporative deposition process is utilized while the overall structure is rotating about an axis normal to the electrodes 12 and 14, as indicated by arrow 30 in FIG. 2. A suitable masking material, for example, aluminum oxide is deposited at a shallow grazing angle, as indicated by arrow 32, onto the upper surface of upper electrode 12 and around each rim 22 so as to form a release layer 34. This release layer also defines the base diameter of its associated protuberance 26, as will be seen. After formation of release layer 34, and while the overall structure is still rotating, deposition of the masking material at the same shallow grazing angle continues simultaneously with the deposition of an electrically conductive material, for example molybdenum, into a apertures 20, above the masking layer and in a direction normal to the electrodes, that is, along the axis of the apertures, as indicated by the arrows 36. As this step continues, the upper opening into each aperture continues to close, resulting in the formation of a single protuberance 26 in each aperture, which protuberance is cone shaped, as stated previously. It is possible to form the base of the protuberance into the shape of a cylinder by initially depositing the electrically connected material into each aperture without first depositing masking material. In either case, after the protuberances are shaped, all of the masking and electrically conductive material deposited on the upper electrode may be readily removed by means of chemically etching away the release layer in order to expose the apertures and protuberances.

Having described the prior art electric field producing structure 10 and its method of manufacture, certain points should be noted. First, it is important to note that each of the protuberances 26 operates most efficiently as an electron emitting cathode when its tip is coplanar with rim 22, as shown in FIG. 1, and when its tip is as close as 25 possible to the rim 22 without actually short-circuiting. By more efficient is meant that the cathode can deliver a greater current for a given voltage under these conditions than would be the case if the tip of the protuberance were below and/or further from the rim. At the same time, when operating in a continuously pulsed mode, this efficiency of operation increases with a decrease in capacitance between the upper and lower electrodes 12 and 14, respectively, and it decreases in efficiency with an increase in capacitance. The capacitance referred to is the capacitance C diagrammatically depicted in FIG. 1 by dotted lines.

With the discussion immediately above in mind, it should be further noted that by the nature of the protuberance 26 formation process it is difficult or impossible to form protuberances 26 with a height H much greater than the aperture diameter D as shown in FIG. 1. With this dimensional relationship, each protuberance 26 is automatically formed such that its height is approximately equal to its base and, more important, it is approximately equal to the height of its aperture, thereby placing its tip in line with the adjacent rim 22 of upper electrode 12. However, because the diameter D of the aperture is equal to its height H, the distance R between tip 28 and rim 22 is relatively large, specifically one-half the height H.

As may be recalled from the discussions above, it is desirable to make the distance between the tip 28 of the protuberance 26 and rim 22, that is, the distance R as small as possible. One way to do that without changing the formation process described above in conjunction with FIG. 2 above is to reduce the diameter D and height H of each aperture while retaining a ratio equal to one between the two in order to ensure that the tips of the protuberances are formed coplanar with rims 22. While this clearly reduces the dimension R since the radius of the aperture itself is reduced, the corresponding reduction in height H between the two electrodes 12 and 14 causes the capacitance C to increase which, as stated above, is undesirable. Thus, reducing the size of the hole in this way is not a satisfactory method of reducing the distance between the tip of each protuberance and its associated rim. In view of the foregoing, it is a primary object of the present invention to decrease the distance between the tip 28 of each protuberance 26 described above and its adjacent upper electrode rim 22 without causing an increase in the capacitance between the upper and lower electrodes.

A more particular object of the present invention is to provide an uncomplicated and yet reliable process for meeting the primary object just recited without departing drastically from the prior art formation process described above in conjunction with FIG. 2.

Another particular object of the present invention is to provide protuberances which are specifically configured to concentrate more of the electric field between the upper and lower electrodes at the tips of the protuberances than heretofore achievable using the prior art formation process described above.

As will be disclosed in more detail hereinafter, the electric field producing structure disclosed herein utilizes upper and lower electrodes and an intermediate dielectric layer corresponding to electrodes 12 and 14 and layer 16 described previously and it includes similar apertures. However, the apertures formed in the structure of the present invention are smaller in diameter D but retain the same depth or height H. This decreases the distance R between the tip 28 of each protuberance and its associated rim 22 without having to decrease the height H and thereby cause the capacitance to increase. This of course assumes that the protuberances 26 can be formed within the narrower apertures so that their tips line up with rims 22. As will be seen hereinafter, this is accomplished by means of a two stage physical evaporative deposition process as compared to the single stage process described above.

BRIEF DESCRIPTION OF THE DRAWINGS

The present invention will be described in more detail below in conjunction with the drawings wherein.

DESCRIPTION OF THE PREFERRED EMBODIMENTS

Figure 1:
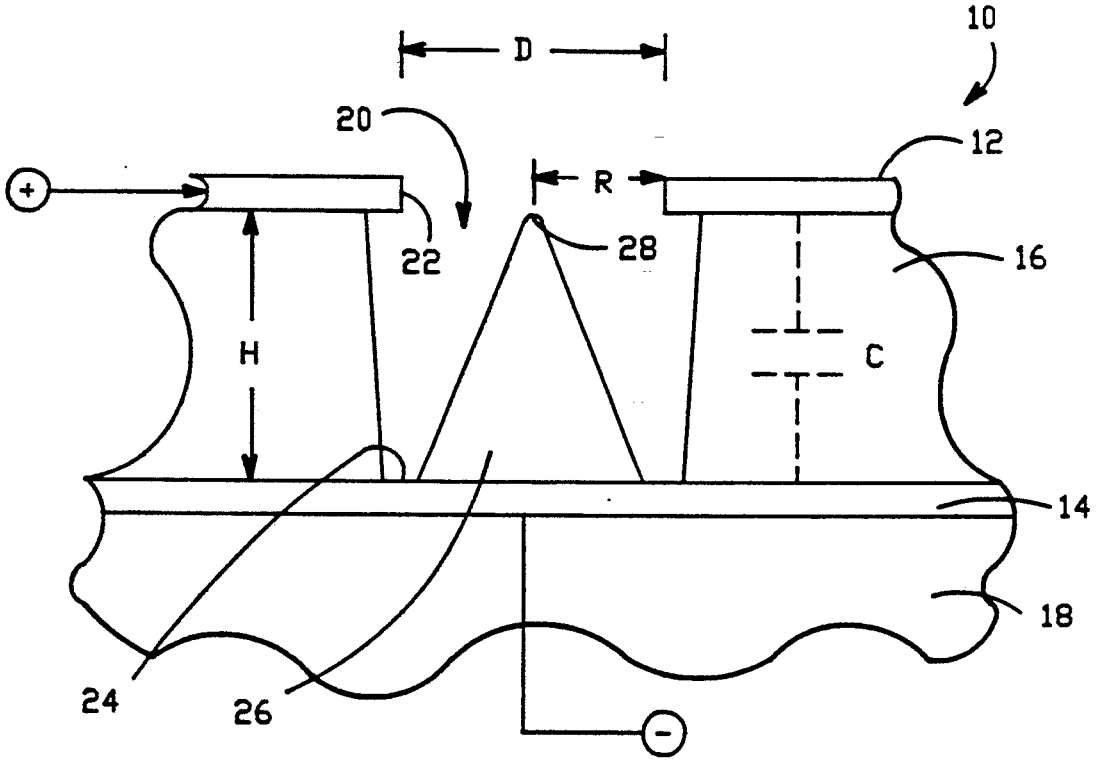
(PRIOR ART) FIG.—1
FIG. 1 is a diagrammatic illustration of an electric field producing structure designed in accordance with the prior art and specifically depicting one of a number of protuberances intended to function as a field emission cathode.
Figure 2:
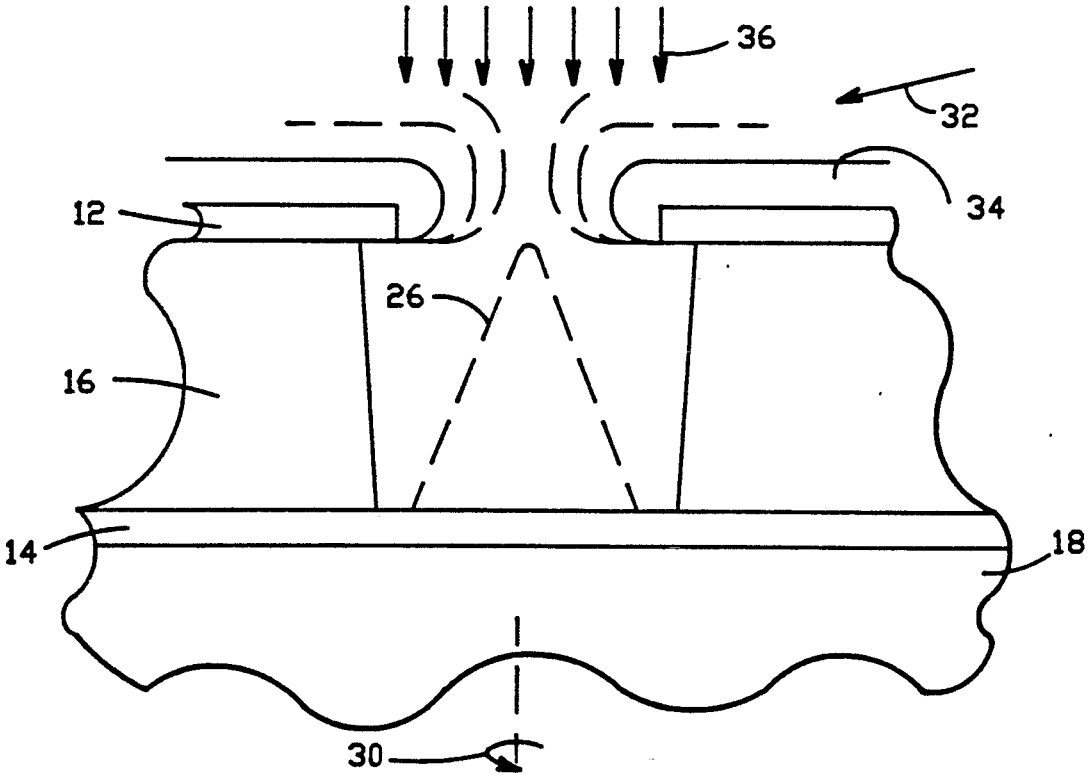
FIG. 2 diagrammatically illustrates the way in which the protuberance shown in FIG. 1 is formed in accordance with the prior art.
Figure 3:
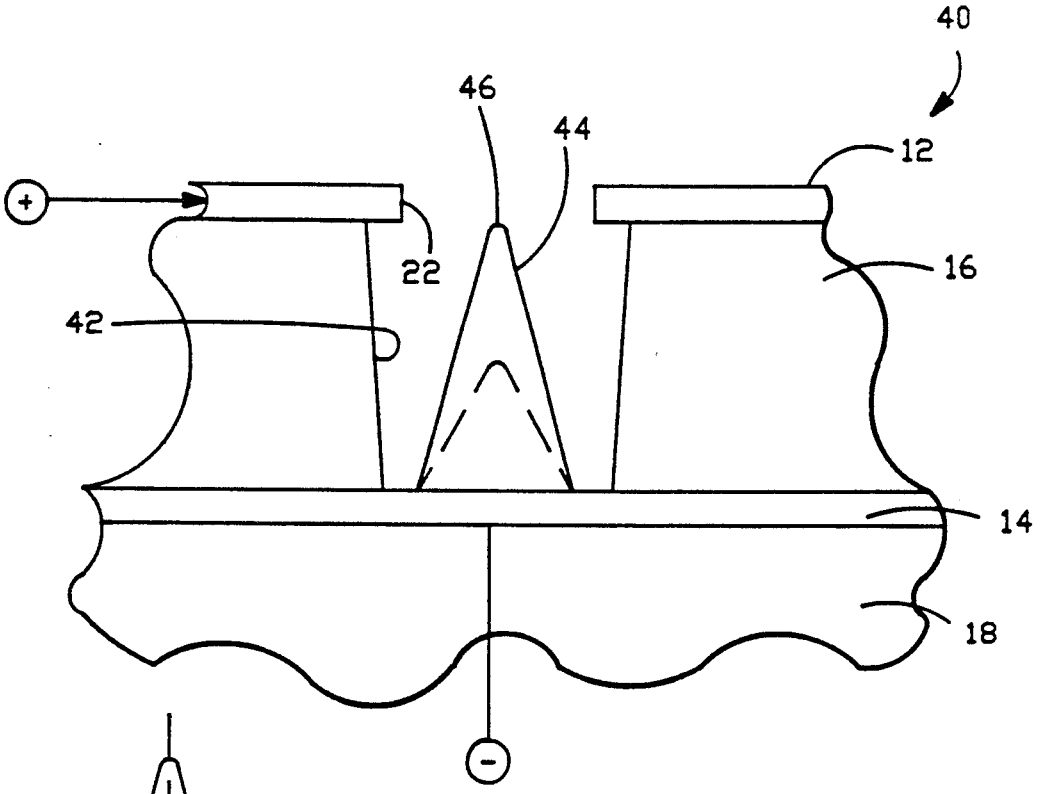
FIG. 3 is a diagrammatic illustration of an electric field producing structure formed in accordance with the present invention and specifically depicting one of a number of protuberances serving as a field emission cathode.

Having described FIGS. 1 and 2 in detail above, attention is immediately directed to FIG. 3 which illustrates an electric field producing structure 40 designed in accordance with the present invention. This structure may include the same upper and lower electrodes 12 and 14 and intermediate dielectric layer 16 on a support base 18 as in previously described structure 10. In addition, structure 40 includes apertures 42 and protuberances 44 corresponding in function to the previously described apertures 20 and protuberances 26. However, in accordance with the present invention, each aperture 42 is substantially narrower than it is deep. In fact, in the embodiment illustrated, the aperture shown, retains the same height or depth H as aperture 20, thereby retaining the same capacitance C, but its diameter D is one-half that of the diameter of aperture 20. At the same time, protuberance 44 displays the same general cone shape as protuberance 26 and is equally as tall, thereby placing its tip 46 at a closer distance to the rim 22 than tip 28. On the other hand, the base of protuberance 44 is approximately half the size of the base of protuberance 26.

Figure 3A:
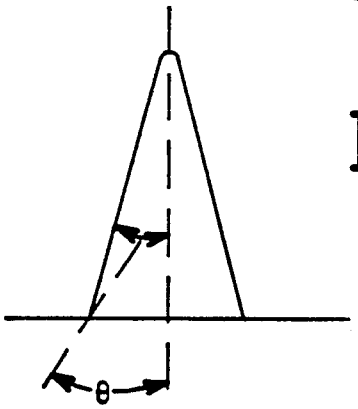
FIG. 3A is a diagrammatic illustration of a protuberance of FIG. 3 apart from the rest of the structure.

As a result of these dimensional differences between apertures 42 and 20 and protuberances 44 and 26, the protuberances 44 function more efficiently as electron emitting cathodes. There are a number of reasons for this. First, the distance between the tip 46 of the protuberance and rim 22 has been cut in half without having to reduce the distance between electrodes and thereby increase capacitance. At the same time, because the diameter of the base of protuberance 44 is smaller than its height (by one-half), the half angle $\theta$ of the cone shaped protuberance, as illustrated in FIG. 3A, is substantially smaller than the corresponding half-angle of protuberance 26 whose base is equal in diameter to its height. This, in turn, causes the electric field produced between the electrodes 12 and to concentrate to a greater extent near the tip of the protuberance which, in turn, causes a greater efficiency of electron emission from the protuberance.

Figure 4A:
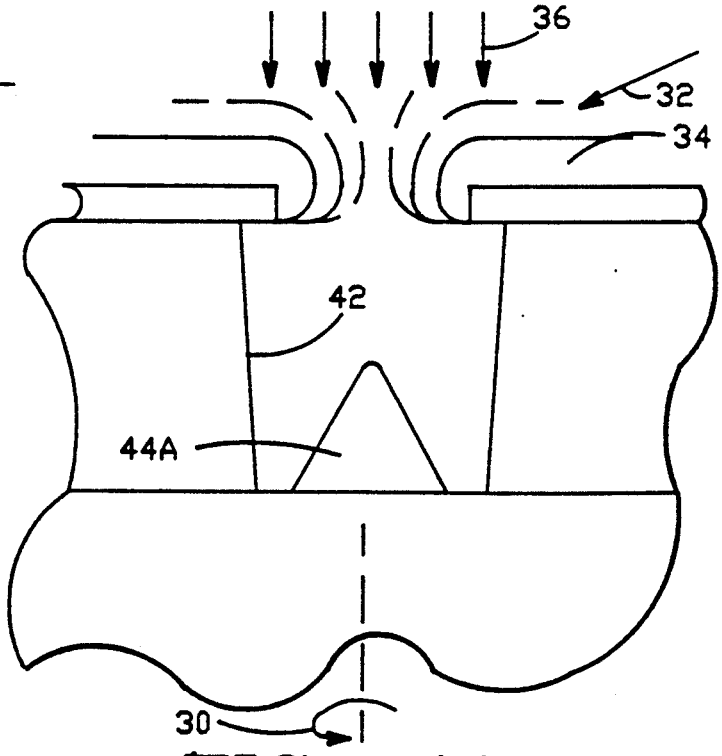
FIGS. 4A and 4B diagrammatically illustrate the way in which the protuberance of FIG. 3 is formed.
Figure 4B:
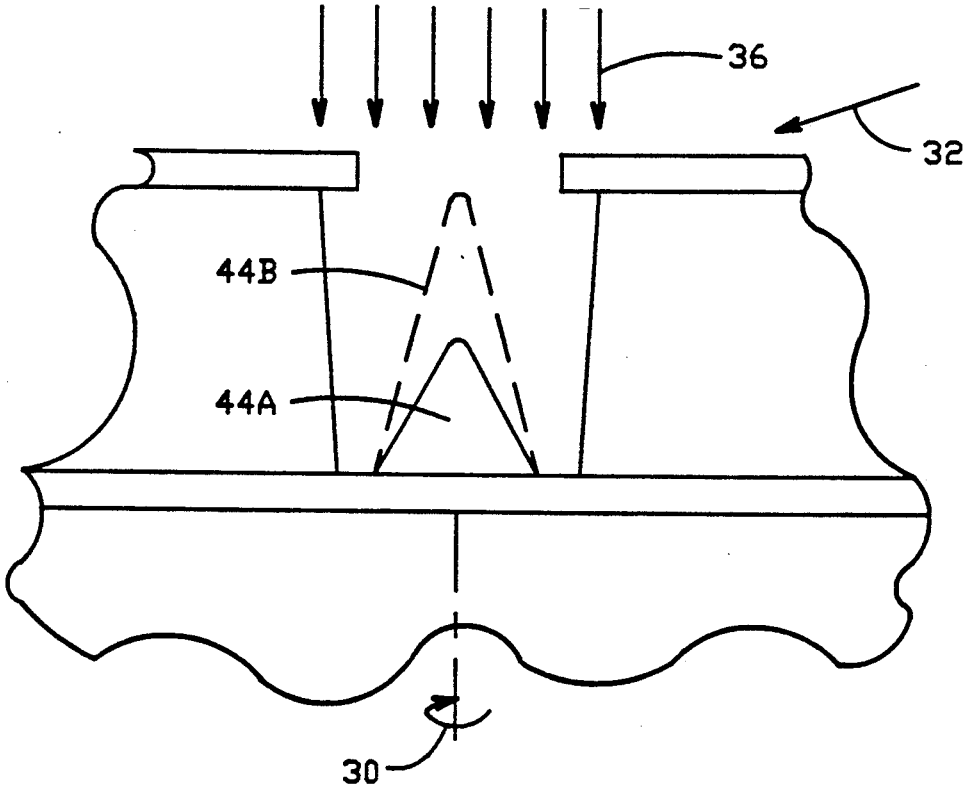

Having described overall structure 40, attention is now directed to the way in which protuberances 44 are formed within their respective apertures 42 and to this end, reference is made to FIGS. 4A and 4B. Starting with FIG. 4A, it should be noted that the overall structure 40, apart from the protuberances 44 may be provided in the same prior art way as structure 10, apart from its protuberances 26, except that apertures 42 are made narrower than they are deep. With this starting structure, a first protuberance 44A is formed in the corresponding aperture 42 in the exact same manner as protuberance 26. Thus, the structure is continuously rotated as indicated by the arrow 30 in FIG. 4A. Thus, a release layer 34 is formed by first depositing a masking material at a shallow grazing angle onto the top of electrode 12, as indicated by arrow 32. Thereafter, a conductive material is applied into each aperture 42, as indicated by arrows 36, while simultaneously applying further masking material. This process forms protuberance 44A in the same manner as protuberance 26. However, because the aperture 42 is narrower than it is deep, the top of the aperture 42 will close off well before the protuberance reaches the top of the aperture, thereby placing the tip of the protuberance 44A well below its rim 22. In fact, where the diameter D of the aperture is equal to one-half its height H, the cone shaped protuberance 44A will have a height equal to approximately half the height of the aperture. This, obviously, is not satisfactory for efficient operation of the protuberance as a field emission cathode. It must be raised in height, as will be seen below in conjunction with FIG. 4B.

Once initial protuberance 44A is formed, all of the masking and electrically conductive material formed on top of electrode 12 is removed so as to again expose aperture 42 and protuberance 44A, as illustrated in FIG. 4B. Thereafter, the same process is repeated, as indicated by the arrows 30, 32 and 36 in FIG. 4B. This results in the formation of a second protuberance 44B on top of protuberance 44A, as indicated by the dotted lines in FIG. 4B. Together the protuberances 44A and 44B form the single previously described protuberance 44. Thus, this two stage physical evaporative deposition process serves to form a single protuberance 44 having a height H equal to that of the aperture itself even though the aperture is deeper than it is wide. This, in turn, places the tip closer to rim 22 without having to increase capacitance C, as discussed above. Moreover, it does so without having to change the protuberance forming process drastically.

Figure 5:
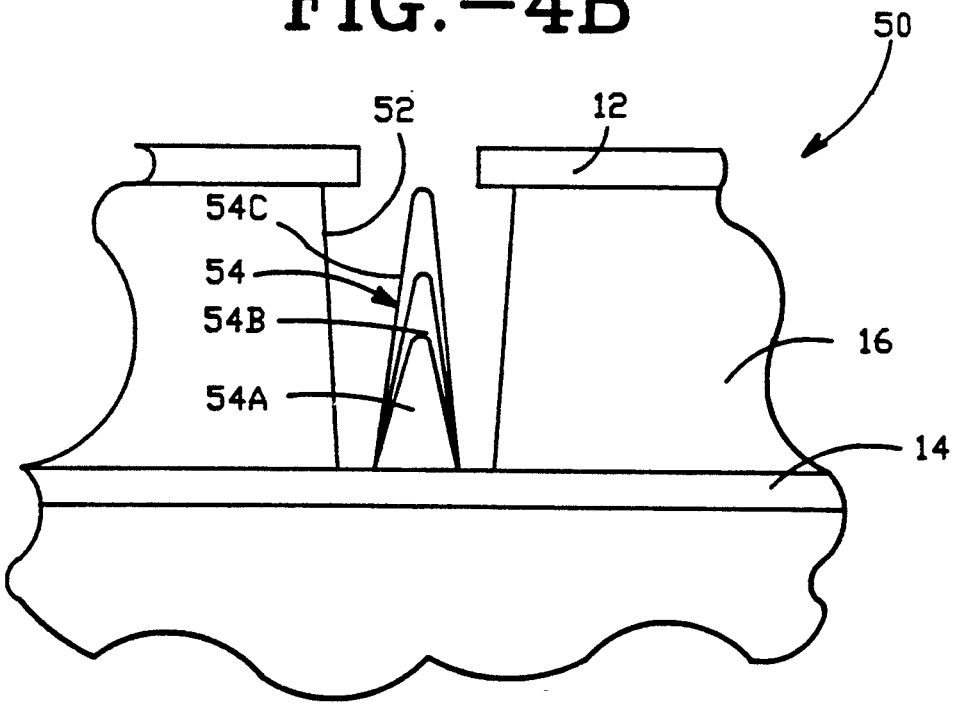
FIG. 5 is a diagrammatic illustration of an electric field producing structure designed in accordance with a second embodiment of this invention.

It is to be understood that the present invention is not limited to a two-stage deposition process of the type described above. An actual embodiment has been formed in which the aperture itself was three times as deep as it was wide. This is illustrated in FIG. 5. The structure shown there is generally indicated by the reference numeral 50 and includes the same upper and lower electrodes 12 and 14 and intermediate dielectric layer 16. However, its apertures 52 are three times as deep as they are wide. At the same time, the protuberance 54 is formed in three stages in the manner described above, starting with a first protuberance 54A, then a second protuberance 54B, and finally a third upper protuberance 54C. Within practical limits, depending on the actual width of the aperture, similar protuberances can be formed in apertures having even smaller diameter to height ratios.

While the embodiments 40 and 50 have been described as including apertures with circular cross sections and cone shaped protuberances, it is to be understood that the present invention is not limited to such configurations. The apertures could be rectangular generally or square in particular, or slots with rounded ends, although the protuberances may be more difficult to form in those cases. Also, it is to be understood that the present invention is not limited to any particular dimensions or any particular materials.

What is claimed is:

1. A method of making and electric field producing structure, comprising the steps of:

(a) providing upper and lower generally planar electrodes spaced apart in parallel confronting relationship to one another with a layer of dielectric material therebetween so as to electrically insulate the electrodes from one another;

(b) forming at least one aperture through said upper electrode and said layer of dielectric material such that the circumferential edge of said upper electrode defining the upper most periphery of said aperture is exposed to a surface segment of said lower electrode defining the bottom of said aperture;

(c) forming a single electrically conductive first protuberance on said surface segment of said lower electrode at the bottom of said aperture, said first protuberance extending upward toward said upper electrode and displaying a height less than the depth of said aperture, whereby its uppermost end lies in a plane parallel with but below said upper electrode; and (d) forming at least one second electrically conductive protuberance over said first protuberance such that the first and second protuberance together form a single protuberance having an uppermost end which is substantially coplanar with but spaced from the first electrode's circumferential edge defining the uppermost periphery of said aperture.

2. A method according to claim 1 wherein said step of forming said single protuberance includes first forming said first protuberance on said confronting surface segment by means of a physical evaporation deposition process and, after said fist protuberance has solidified, enlarging it until it reaches its full size by means of at least one subsequent evaporation process step.

3. A method according to claim 1 wherein the ratio of the cross-sectional width of said aperture divided by the distance between the aperture and said confronting surface is approximately 0.5 and wherein the height of said beginning aperture is approximately equal to one half the distance between said aperture and said confronting surface.

4. A method according to claim 1 wherein said aperture has a circular cross-section and a diameter-to-height ratio of not more than approximately 0.5, and wherein said first protuberance is cone-shaped at its base which is below its tip and has a base-to-height ratio approximately equal to one.

5. A method according to claim 1 wherein the ratio of the diameter of said aperture to its height is between approximately 0.5 and 0.33.

6. A method according to claim 1 wherein each of said first and second protuberances is formed by means of a physical evaporative deposition process.

7. A method according to claim 5 wherein the chemical deposition process for forming said first protuberance includes the steps of:

(a) first, depositing a masking layer at a shallow grazing angle on the upper surface of said upper electrode whereby to provide a release layer on said upper electrode and a built-up lip or mask of controlled diameter around the first electrode's circumferential edge defining the upper periphery of the aperture;

(b) second, depositing an electrically conductive material into said aperture from above said upper electrode in the direction substantially perpendicular to the plane of said pair of electrodes, whereby said conductive electrical material is deposited on the surface segment of said lower electrode defining the bottom of said aperture and thereby forming said first protuberance; and (c) removing said masking and electrically conductive material from the upper surface of said electrode, whereby to completely expose said aperture and said first protuberance.

8. A method according to claim 6 wherein said physical evaporative deposition process for forming said second protuberance includes the steps of:

(a) first, depositing a masking material at a shallow grazing angle on the upper surface of said upper electrode, whereby to provide a release layer on said upper electrode and a built-up lip or mask of controlled diameter around the upper electrode's circumferential edge defining the periphery of said aperture; and (b) second, depositing an electrically conductive material into said aperture from above said upper electrode in the direction substantially perpendicular to the plane of said electrodes, whereby said conductive material is deposited on said first protuberance and thereby forms said second protuberance.

9. A method according to claim 7 wherein said process for forming said second protuberance includes the step of depositing said masking layer on said upper electrode at said shallow grazing angle while said electrically conductive material is deposited in said aperture.

* * * * *